United States Patent [19]

Sato

[11] 4,178,849

[45] Dec. 18, 1979

[54] INKING DEVICE FOR LABEL PRINTING AND APPLYING MACHINE

[75] Inventor: Yo Sato, Tokyo, Japan

[73] Assignee: Kabushiki Kaisha Sato Kenkyusho, Tokyo, Japan

[21] Appl. No.: 830,187

[22] Filed: Sep. 2, 1977

Related U.S. Application Data

[60] Continuation-in-part of Ser. No. 813,291, Jul. 6, 1977, abandoned, which is a division of Ser. No. 787,937, Apr. 15, 1977.

[30] Foreign Application Priority Data

Apr. 26, 1976 [JP] Japan ..... 51-46606
Jul. 6, 1976 [JP] Japan ..... 51-79440

[51] Int. Cl.[2] ..... B41J 3/60; B41F 1/50

[52] U.S. Cl. ..... 101/305; 101/288; 101/359; 101/324; 101/320; 101/314

[58] Field of Search ..... 101/287, 288, 291, 292, 101/359, 360, 305, 324, 320, 321, 324, 314, 299–304

[56] References Cited

U.S. PATENT DOCUMENTS

| | | | |
|---|---|---|---|
| 1,398,076 | 11/1921 | Lang | 101/360 |
| 3,364,855 | 1/1968 | Boekello et al. | 101/359 |
| 3,417,689 | 12/1968 | Brethen | 101/292 |
| 3,705,833 | 12/1972 | Wada | 101/292 |
| 3,721,187 | 3/1973 | Levinson | 101/359 |
| 3,800,701 | 4/1974 | Martin | 101/288 |

FOREIGN PATENT DOCUMENTS

| | | | |
|---|---|---|---|
| 385058 | 11/1923 | Fed. Rep. of Germany | 101/360 |
| 469556 | 12/1928 | Fed. Rep. of Germany | 101/360 |
| 587040 | 10/1933 | Fed. Rep. of Germany | 101/360 |

*Primary Examiner*—William Pieprz
*Attorney, Agent, or Firm*—Ostrolenk, Faber, Gerb & Soffen

[57] ABSTRACT

An inking device for a label printing and applying machine, or the like: the inking device has a multi-link mechanism which comprises yoke arms operated by the squeezing of a hand lever, a supporting member for supporting inking rollers, a plurality of links operatively connecting the yoke arms and the supporting member, and a guiding means formed in the links for guiding the inking rollers; when the hand lever is squeezed, the multi-link mechanism moves the inking rollers into the body of the label printing and applying machine and past the type faces and stores the inking rollers therein.

13 Claims, 9 Drawing Figures

INKING DEVICE FOR LABEL PRINTING AND APPLYING MACHINE

RELATED APPLICATIONS

This is a continuation-in-part of application Ser. No. 813,291, filed July 6, 1977, now abandoned, which is a division of application Ser. No. 787,937, filed Apr. 15, 1977.

BACKGROUND OF THE INVENTION

1. Field of the Invention

This invention relates to a print head type face inking device for use in a label printing and applying machine, or the like machine. The inking device applies ink evenly so as to attain precise printing of labels.

2. Description of the Prior Art

In conventional label printing and applying machines and tag printing and attaching machines, devices for applying ink to the type faces of the printing heads usually comprise inking rollers that are attached to the free ends of spring-actuated rocking arms. The inking rollers are pressed to and rolled over the type faces so as to apply the ink.

A typical inking device of this type comprises a pair of spring-actuated rocking arms attached to the front end portion of the printing machine body. A supporting frame carrying an inking roller is attached to the rocking arms through springs. When the hand lever of the printing machine is squeezed, the rocking arms are turned simultaneously, and this moves the inking roller supporting frame. Thus, the inking roller is rolled over the type faces of the printing head. This conventional inking device has a number of disadvantages:

(a) Since the inking roller is brought into contact with the type faces by spring action, ink application is liable to deteriorate when the force of the spring becomes weakened after long use of the machine. Therefore, the printing of labels becomes indistinct, which is fatal to optical character reading systems requiring highly precise printing.

(b) When the inking roller spring force becomes weak, only the ink contained in the portion near the surface of the inking roller is used, because the type faces no longer dig deeply into the inking roller and the ink that is impregnated in the middle portion of the inking roller is not pumped out. Therefore, the printing of numerous labels is impossible, which is uneconomical.

(c) When the hand lever of the printing machine is squeezed quickly, the inking roller sometimes makes slight contact or no contact with type faces due to the rebounding action caused by the squeeze. Thus, reliable printing cannot be expected.

(d) Strong force is necessary to operate such label printing machine, so that some operators, like the weaker ones, are tired by long term handling of a machine.

(e) In the conventional label printing machine, the rocking arms, supporting frame and inking roller are moved forwardly through the front part of the printing machine when the hand lever is fully squeezed until they protrude in front of the machine frame. The protruding parts obstruct the operator's view as the just printed label is being applied to the surface of an article, and accurate application of the label becomes difficult.

SUMMARY OF THE INVENTION

It is one object of the present invention to provide an improved inking device for use in a label printing and applying machine, or the like, in which the force required for squeezing the hand lever is effectively reduced.

Another object of the present invention is to provide an inking device for a label printing and applying machine, in which inking rollers are brought into contact with the type faces of the printing head at a constant pressure so as to evenly apply a suitable amount of ink to the type faces, thereby attaining precise and uniform printing of labels over long periods of time of operation.

A further object of the present invention is to provide such an inking device in which the inking rollers carried by a multi-link mechanism are stowed inside the machine body following the squeezing of the hand lever. Thus, there is no obstacle to the operator's view as labels are applied to the surfaces of articles.

Still a further object of the present invention is to provide such an inking device in which the inking device is simple in structure, durable in use and produced easily at low cost.

In accordance with the present invention, there is a multi-link mechanism for the inking device which comprises yoke arms that are operated by the squeezing of a hand lever, a supporting member for supporting the inking rollers, and a plurality of links operatively connecting the yoke arms and the supporting member. A guiding means for guiding the inking rollers is formed in the link mechanism. When the hand lever is fully squeezed, the link mechanism moves the inking rollers to a location inside the body of the label printing and applying machine so as to be stowed therein.

The link mechanism is further provided with a pair of fixed fulcrums attached to the machine frames, two other pairs of fixed fulcrums attached to the yoke arms and a plurality of pairs of movable fulcrums, all connecting the links. Furthermore, the link mechanism is provided with a pair of spring-actuated operation links which are attached to one pair of the fixed fulcrums, and a pair of rocking links which are attached to the other pair of fixed fulcrums on the yoke arms. The guiding means for the inking rollers comprise supporting shaft that are secured to the supporting member of the inking rollers and slots formed in the links to guide the supporting shafts.

BRIEF DESCRIPTION OF THE DRAWINGS

The foregoing and other objects and features of the present invention will become more apparent from the following description taken in connection with the accompanying drawings, in which.

DESCRIPTION OF A PRIOR ART EMBODIMENT

Figure 9:
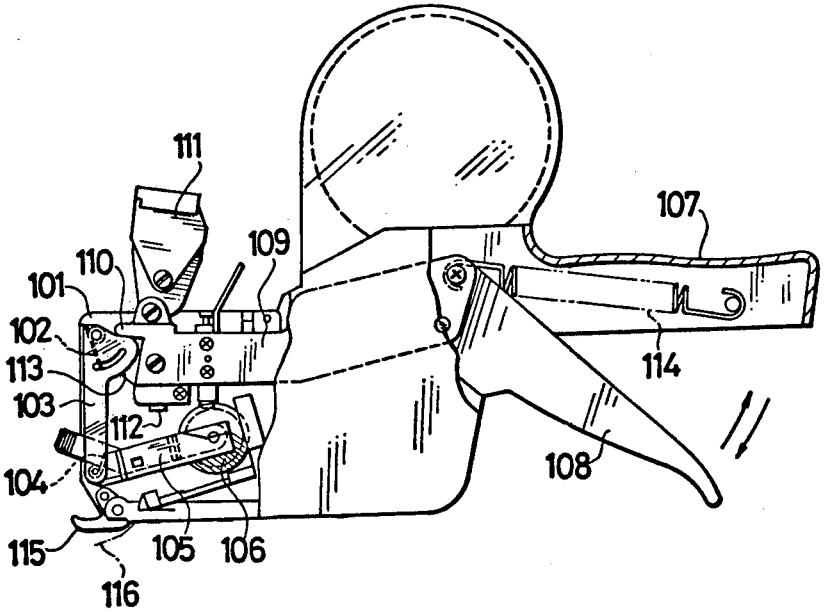
FIG.9 PRIOR ART
FIG. 9 is a partially cut-away, side view of a label printing and applying machine, which is provided with an inking device that is in the conventional art.

A conventional inking device is described with reference to FIG. 9. The device comprises a pair of rocking arms 103 that are pivotally secured to the end portion of a machine frame 101 and that are urged to move counterclockwise by a spring 102. To the free ends of the rocking arms 103 is pivotally attached a supporting frame 105, which is also urged counterclockwise by a spring 104. An inking roller 106 is rotatably fitted to the free ends of the supporting frame 105.

When a stationary hand grip 107 secured to the machine frame and a pivotable hand lever 108 are squeezed together, yoke arms 109 attached to lever 108 are turned down or counterclockwise and the cams 113 formed on the rocking arms 103 are depressed by the projections 110 that are provided at the free ends of the yoke arms 109. Thus, the rocking arms 103 are turned clockwise, which shifts the supporting frame 105 clockwise to the left. The inking roller 106 is thereby moved and rotated in contact with the type faces 112 of a printing head 111 and applies ink to the type faces.

The above described conventional inking device has several disadvantages:

(a) Since the inking roller 106 is pressed against the type faces 112 by means of the springs 102 and 104, the contact pressure of the inking roller 106 against the type faces 112 is liable to become weakened when the forces of the springs are weakened owing to spring fatigue after a long time and repeated uses. Ink application cannot be done properly in such state, and the impression printed on the label becomes indistinct. When a label printing machine is used for printing labels for optical character readers that utilize laser beams, for example, the indistinctness of the printing is a fatal defect, since high precision printing is required for optical character readers.

(b) When the spring force becomes weak, the printing type faces are not pressed into the inking roller, so that the ink impregnated in the inner portion of the inking roller does not ooze out and only the ink near the surface of the inking roller is used.

(c) When the hand lever 108 is quickly squeezed, the inking roller sometimes does not contact with the type faces 112 due to the reaction to such quick motion. In some cases, the inking roller 106 only makes very weak contact.

(d) Large force is necessary to squeeze the hand grip 107 and the hand lever 108 together because it is necessary to overcome the force of drive spring 114, that is stretched inside the grip 107 and that urges the hand lever 108 and yoke arms 109 always clockwise, and the forces of springs 102 and 104.

(e) Further, when the hand lever 108 is fully squeezed, the rocking arms 103, supporting frame 105 and inking roller 106 protrude in front of the label printing machine. Therefore, when the printed label 116 that is under the applicator 115 is to be applied to the surface of an article, it is hard to see the label 116, and it becomes difficult to apply the printed label 116 accurately.

DESCRIPTION OF A PREFERRED EMBODIMENT

FIGS. 1–8 show a hand operated label printing and applying machine which is provided with an inking device A of the present invention. The label printing machine is now described with reference to FIGS. 1–3. An opposed pair of machine frames 44 extend rearwardly to define an integral hand grip 1. On the underside of the hand grip 1, a hand lever 2 is pivotally connected on a shaft 3. The front side of the hand lever 2 extends into bifurcated yoke arms 40, which carry a printing head 45 having stamp belts that are arrayed side by side. On the underside of the printing head 45, types 46 on the stamp belts are arranged so as to print labels.

A return spring 47 is stretched between a pin 48 formed on the hand grip 1 and a fixing hole 49 formed near the pivoted portion of the hand lever 2. Thus, when the hand lever 2 is released, it is spring returned to its rest position.

Figure 3:
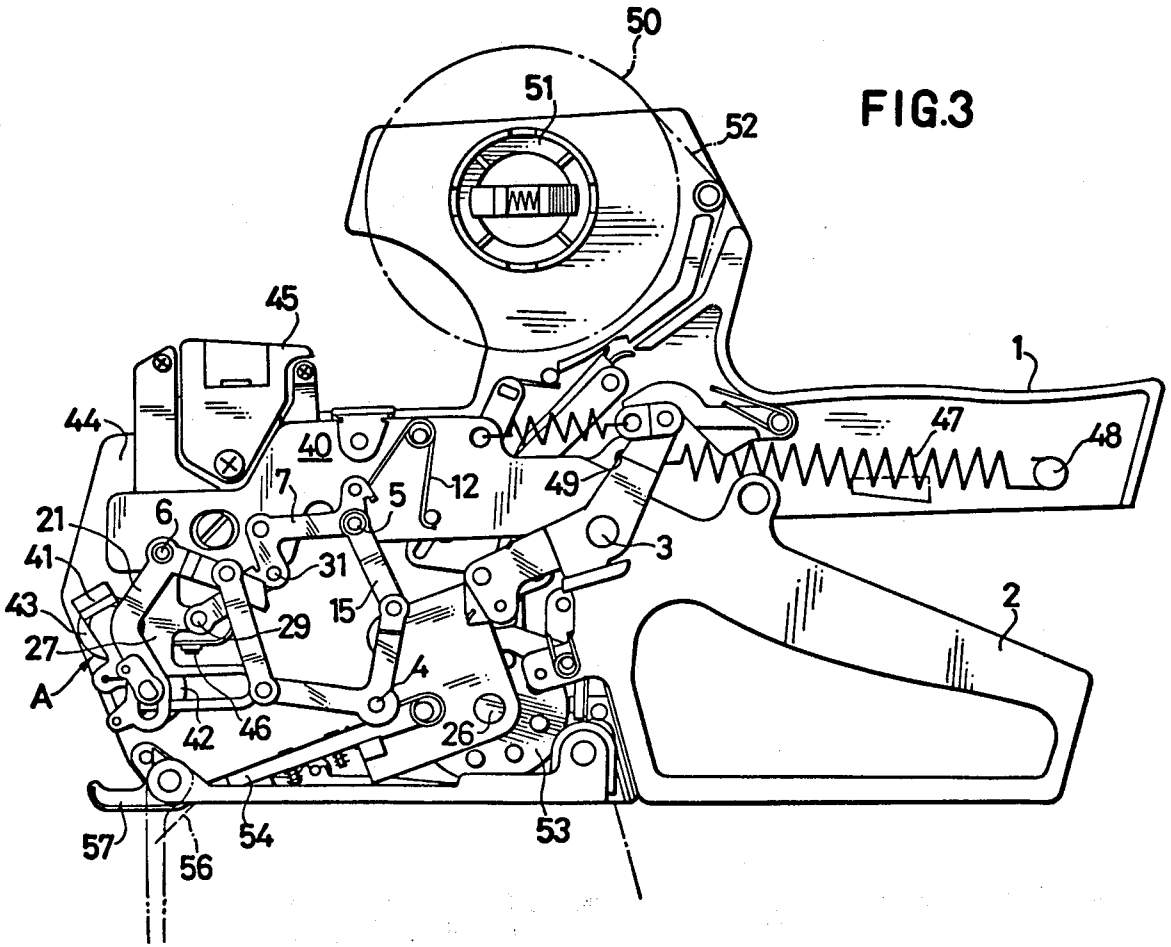
FIG. 3 is a side view of the machine, in which the machine frame on the viewing side is removed and the hand lever is in the released position.
Figure 4:
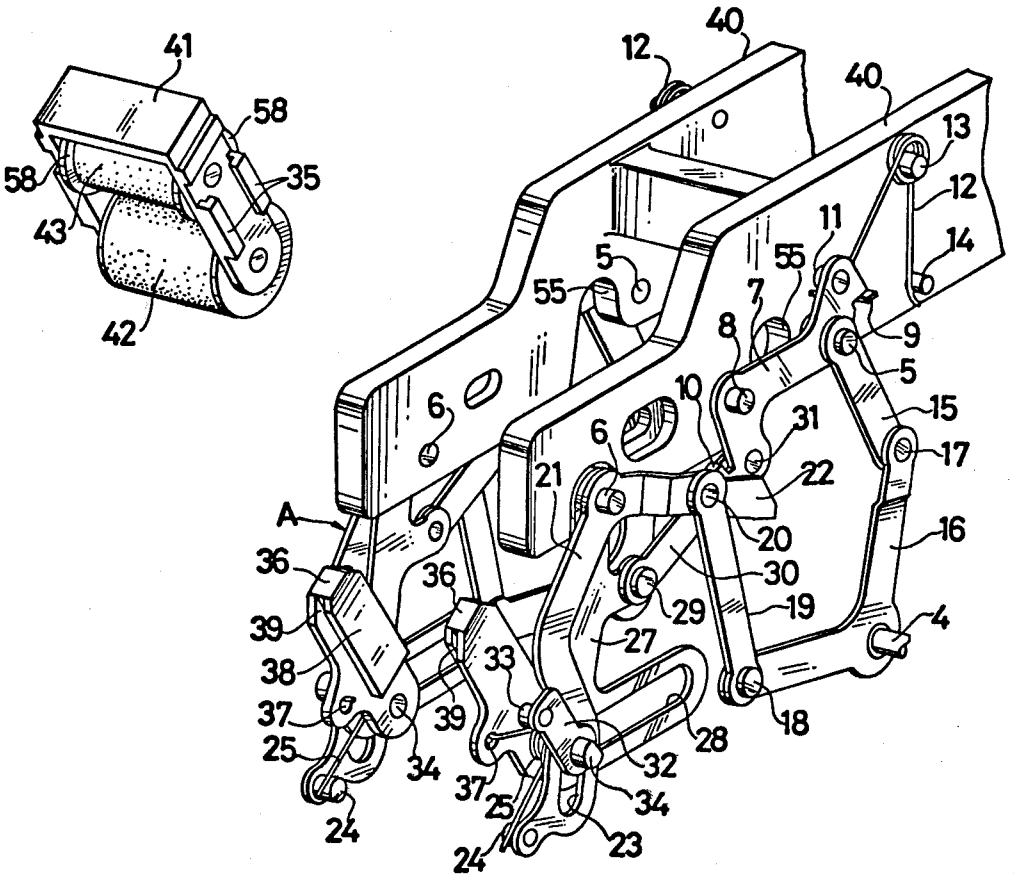
FIG. 4 is a perspective view of the main portion of the embodiment of the inking device of the invention.

The inking device A of the present invention comprises a multi-link mechanism having inking rollers, which apply ink to the type faces of the printing head 45 in interlocked movement with the squeezing of the hand lever 2. As shown in FIGS. 3 and 4, this multi-link mechanism comprises a first pair of fixed fulcrums 4 which are each pivotally secured to one of the pair of machine frames 44, and a second and third pair of fulcrums 5 and 6, respectively, which are each pivotally secured to one of the pair of yoke arms 40.

Since the multi-link mechanism is symmetrical at both sides of the pair of yoke arms 40, this multi-link mechanism will only be described from one side.

An operation link 7, having an S-shape, and a connecting link 15 are pivotally connected at the second fixed fulcrum 5 on the yoke arm 40. The operation link 7 has a contact pin 8 formed on its outside near its middle, a stopper projection 9 also formed on its outside at its rear end, an engaging projection 10 formed by bending the link 7 inward and located at its front end, and a spring pin 11 formed on its inside at its rear end. The operation link 7 is urged counterclockwise (in the depressing direction) about the second fulcrum 5 by a spring 12. The spring 12 is supported by a supporting pin 13 on the yoke arm 40. One end of the spring 12 is fitted to the spring pin 11 of the operation link 7 and the other end of the spring is fitted to another spring pin 14 on the yoke arm 40.

To the third fulcrum 6 on the yoke arm 40 are pivotally connected the leg end of an F-shaped guide link 27 and the leg of an L-shaped rocking link 21.

The guide link 27 is provided at the cross arm opposite its end with a horizontally extending (in FIG. 4) slot 28 which guides the inking roller frame 41. There is a projection 29 at the outside of the end of the central cross arm of the link 27. An I-shaped operation link 30 is pivotally attached by a movable fulcrum to projection 29. The operation link 30 is connected to the operation link 7 by a movable fulcrum 31, and the link 30 can be pivoted into engagement with the engaging projection 10 of the operation link 7. Thus, the operation link 30 is held in the depressed position through the projection 10 by the force exerted by the spring 12 in its rest position. In the rest position, the movable fulcrum 31 between the operation links 7 and 30, the second fulcrum 5 of the operation link 7, and the movable fulcrum 29 of the guide link 27 are positioned generally along a straight line.

In order to move the inking roller frame 41, a vertical slot 23 is formed at the lower end of the vertical leg of the rocking link 21. The outer end of the other leg of the rocking link 21 is provided with an upraising extension portion 22, which engages the contact pin 8 on the operation link 7. Near the upraising portion 22, the connecting link 19 for a driving link 16 is attached at a movable fulcrum 20.

The driving link 16 is pivotally attached to the machine frame 44 at first fixed fulcrum 4. The upper end of the vertical leg of the link 16 is connected to the connecting link 15 at a movable fulcrum 17. The opposite, lower end of the other leg of the link 16 is connected to another connecting link 19 at a movable fulcrum 18. Accordingly, the lower end of the driving link 16 pivots the rocking link 21 back and forth around fulcrum 6 through the connecting link 19.

The supporting member 36 for supporting the inking roller frame 41 has an outwardly projecting supporting shaft 34 having a roller, which is slidably fitted into both the vertical slot 23 of the rocking link 21 and the horizontal slot 28 of the guide link 27. A spring 25 is attached around the supporting shaft 34. To the outside of the supporting shaft 34 is fixed a receiving piece 32 having a stop pin 33. The guide link 27 and the rocking link 21 are interposed between the inside surface of the receiving piece 32 and the outside surface of the supporting member 36.

One end of the spring 25 is fitted into the spring hole 37 formed in the supporting member 36 and the other end of the spring 25 is pressed against the spring pin 24 formed on the rocking link 21, thereby urging the supporting member 36 clockwise about the supporting shaft 34. The receiving piece 32 is prevented from rotation since the stop pin 33 is brought into contact with the rocking link 21.

The supporting members 36 are attached to the front end portions of multi-link mechanisms provided symmetrically on both sides of the longitudinal and vertical center plane. Each of the supporting members 36 is provided on its inside with an attaching portion 38 having front and rear engaging grooves 39. Both outer side surfaces of the inking roller frame 41 are provided with attaching lugs 35, by which the inking roller frame 41 is attachable to the engaging grooves 39 of the attaching portions 38. Frame 41 carries a larger and a smaller inking roller 42 and 43, respectively.

Figure 1:
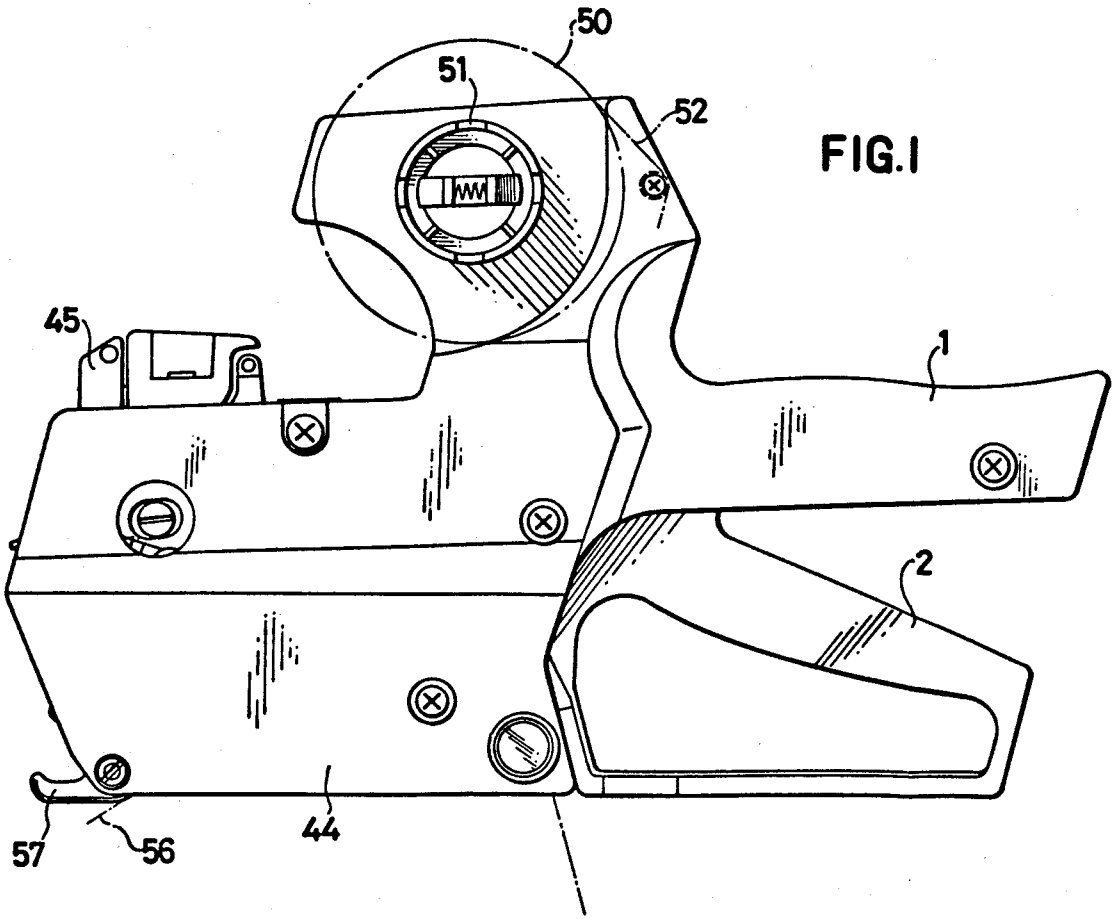
FIG. 1 is a side elevational view of a label printing and applying machine, which is provided with an embodiment of the inking device of the present invention.
Figure 2:
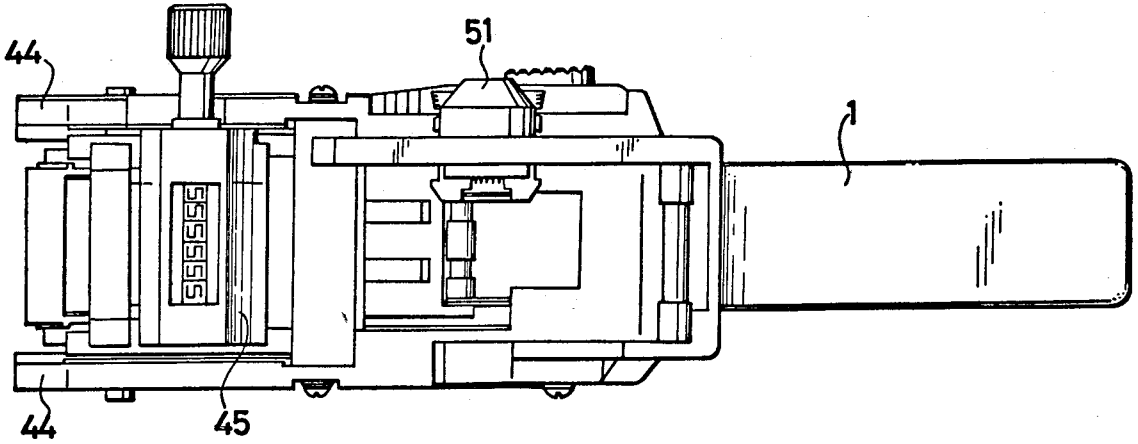
FIG. 2 is a plan view of the machine.

In FIGS. 1–3, the rolled label strip 50 is detachably fitted to a supporting device 51. A tape-like label strip 52 is drawn out from the rolled label strip 50 and is fed over a feeding roller 53 and the labels are delivered to a platen 54 on which printing of each label is effected.

The operation of the inking device is now described, with particular reference to FIGS. 3 and 5–8.

Figure 5:
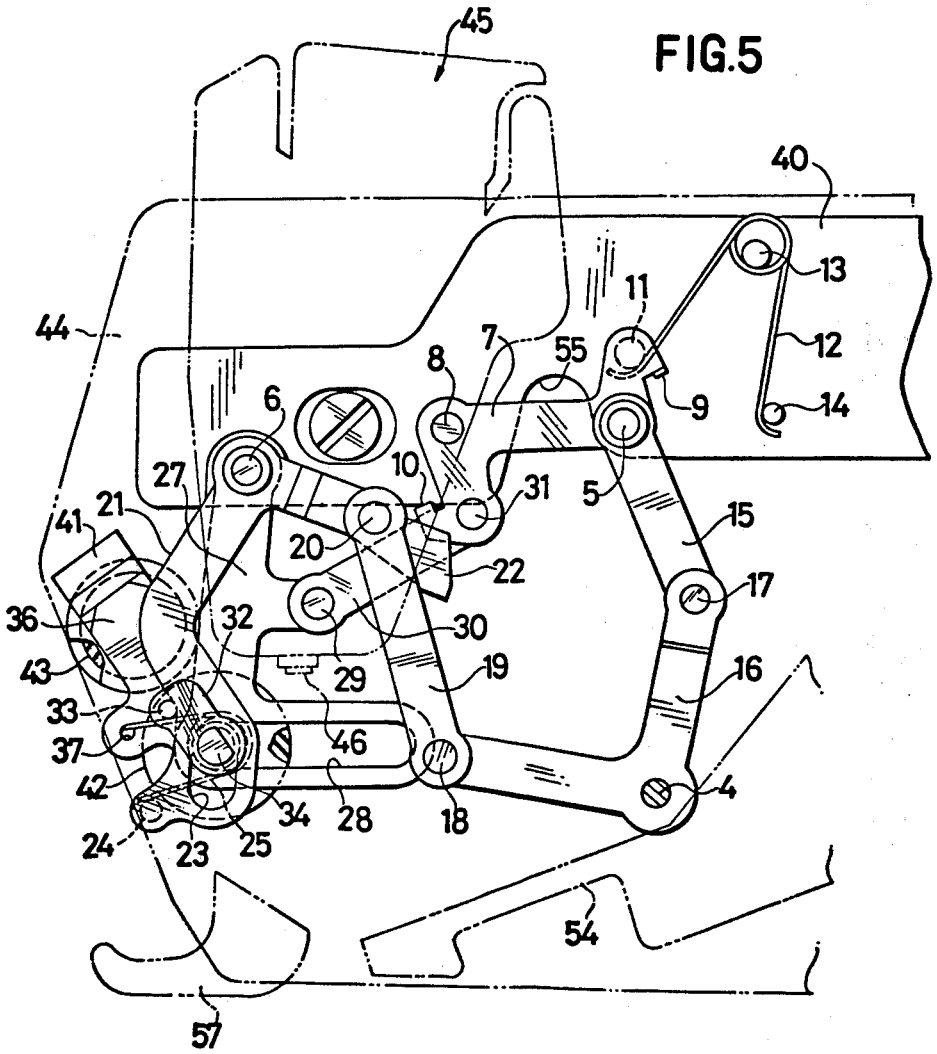
FIG. 5 is a side view of the inking device in a rest position.
Figure 6:
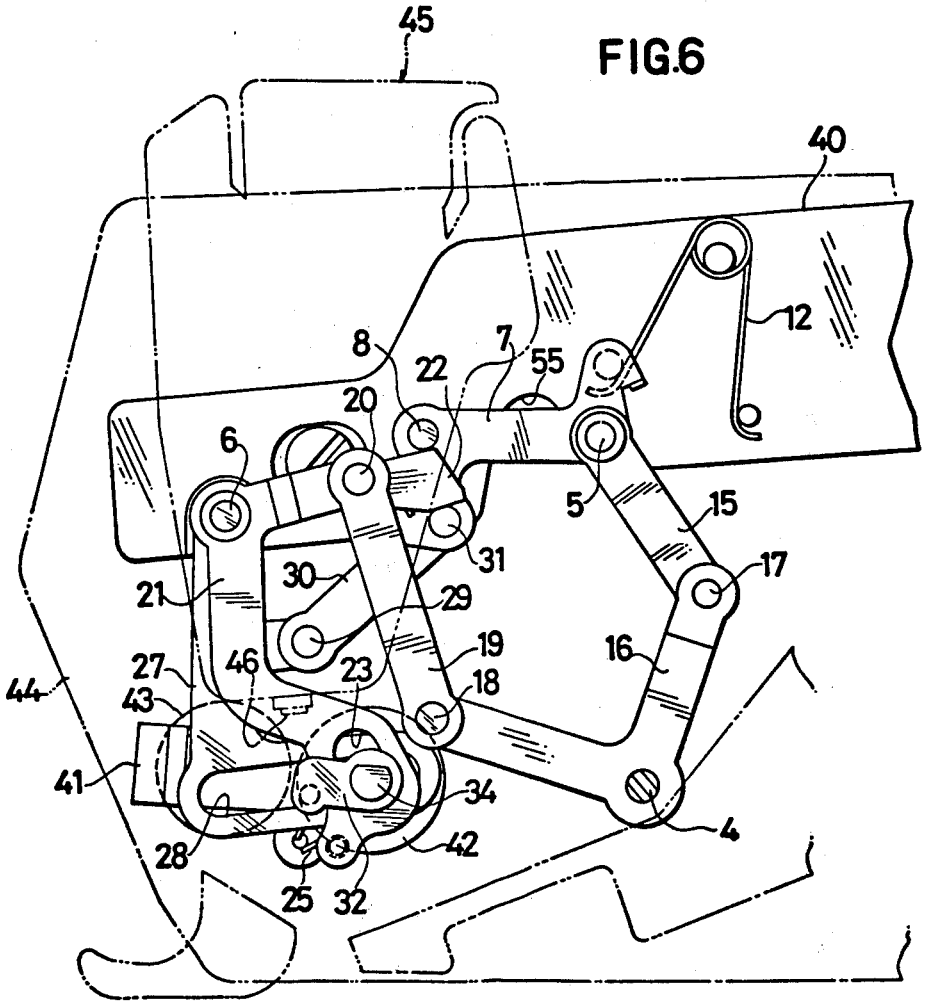
FIG. 6 is a side view of the inking device in which an upraising portion is brought into contact with the contact pin of the multi-link mechanism.
Figure 7:
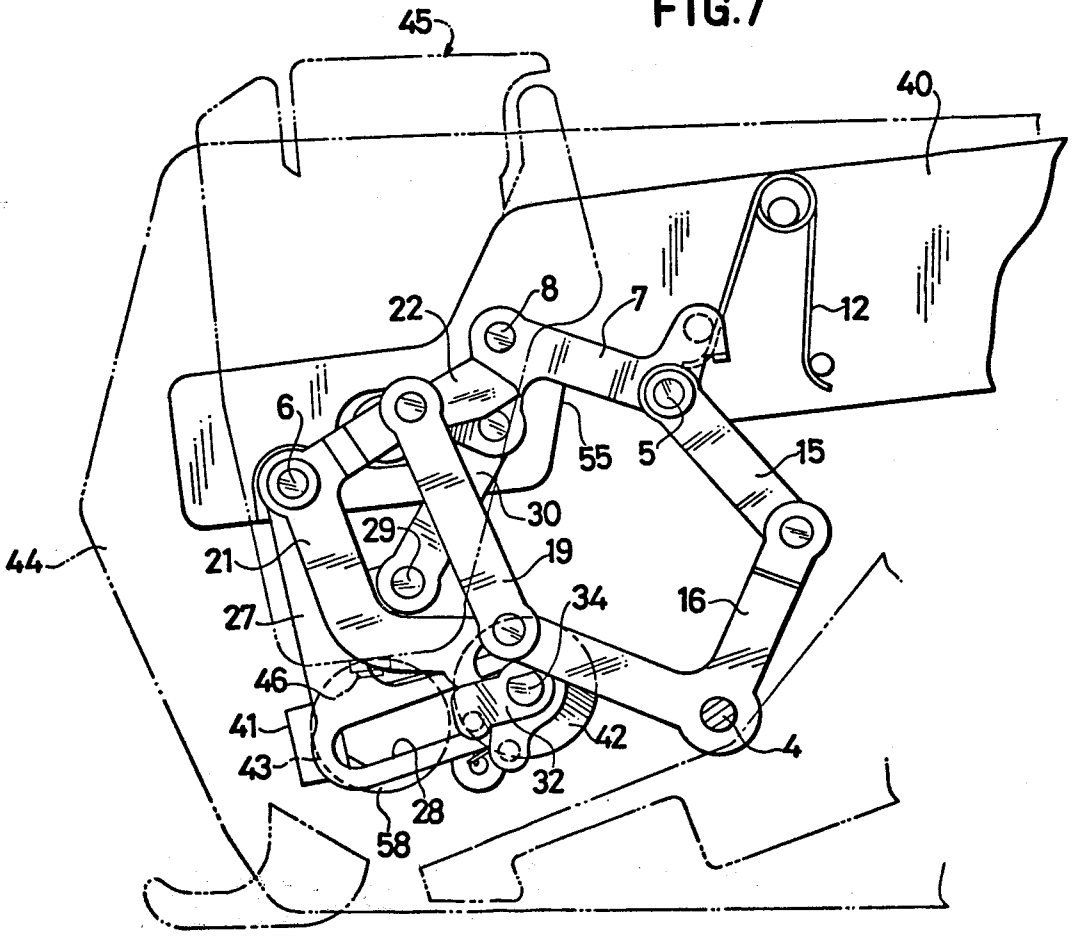
FIG. 7 is a side view of the inking device, showing ink being applied to the type faces of a printing head by inking rollers.

In FIGS. 3 and 5, which show the rest position, when the hand lever 2 is slightly squeezed (at a squeezing angle of 3°), the yoke arms 40 are turned counterclockwise about the pivot shaft 3 to a small extent in the depressing direction, as shown in FIG. 6.

The multi-link mechanism connected to the yoke arm 40 is operated. The second and third fulcrums 5 and 6 on the yoke arm 40 are moved down, so that the movable fulcrum 17 on one side of the driving link 16, which link is attached to the machine frame 44, is moved to the right, while the other movable fulcrum 18 on the other side of the link 16 is correspondingly moved almost upward. At the same time, the rocking link 21 is turned counterclockwise about the third fulcrum 6. The contact pin 8 of the operation link 7 is contacted by the upraising portion 22 of the rocking link 21.

The supporting member 36 and the supporting shaft 34 for inking roller frame 41, which are pressed to the upper end of the vertical slot 23 by the spring 25, are guided to the right end portion of the horizontal slot 28 of the guide link 27 by the pivoting rocking link 21. During this motion, the first inking roller 42, under the guidance of slot 28, provides a first inking to the type faces 46 of the printing head 45, as shown in FIG. 6.

Simultaneously with this first inking, since the rocking link 21 has turned counterclockwise about the third fulcrum 6, the upraising portion 22 of the link 21 is pressed against the contact pin 8 of the operation link 7 which is in engagement at 31 with the other operation link 30. Thus, the mechanism moves into the state shown in FIG. 7.

When the force exerted by the upraising link portion 22 against the contact pin 8 overcomes the force of spring 12, the operation link 7 is turned further clockwise. As a result, the engagement between the operation link 30 and the engaging projection 10 of the operation link 7 (see FIG. 5) is released. Thereafter, both operation links 7 and 30 become released. In other words, one operation link 7 is turned clockwise about the second fulcrum 5, while the other operation link 30 is turned counterclockwise about the movable fulcrum 29 and they move together around fulcrum 31. This further lifts the portion 22 of link 21 and the link 21 moves further counterclockwise, whereby the second inking roller 43 is moved to give a second ink application to the type faces 46.

Following the second ink application, the supporting shaft 34 of the inking rollers is at the right end of the horizontal slot 28 of the guide link 27.

Figure 8:
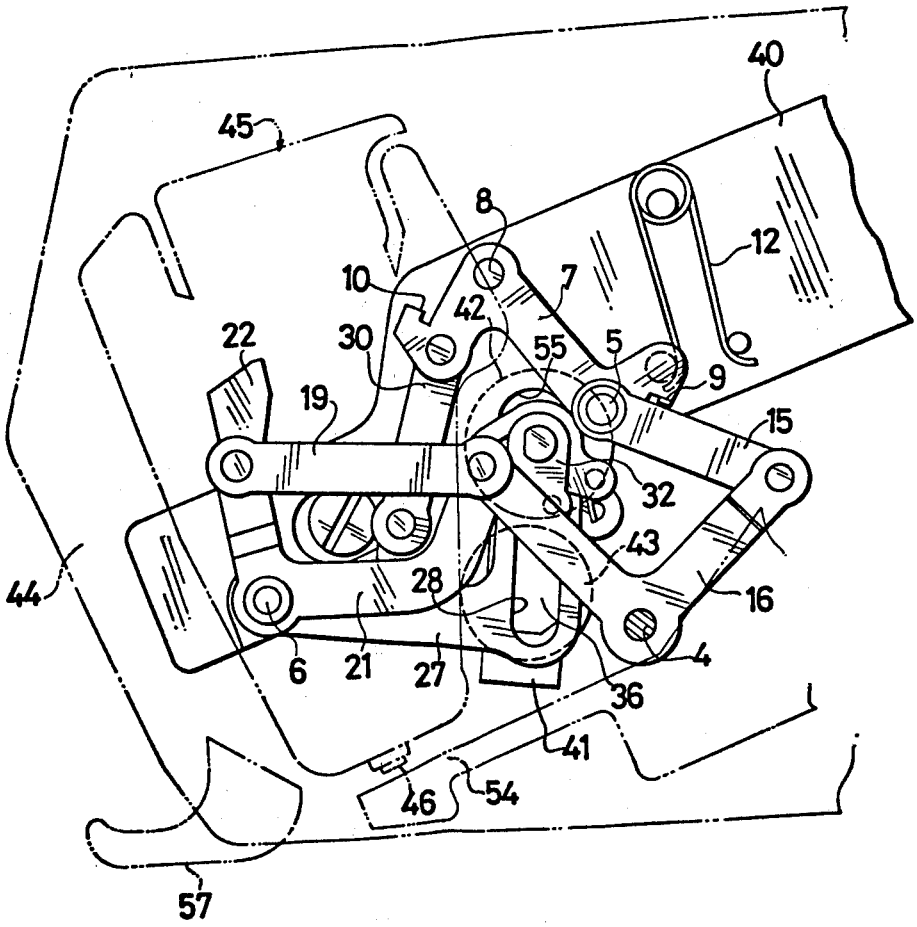
FIG. 8 is a side view of the inking device, showing the multi-link mechanism and the inking rollers being received within the machine body.

When the hand lever 2 is further squeezed, as shown in FIG. 8, both the guide link 27 and the rocking link 21 are turned counterclockwise with the simultaneous movement of each movable fulcrum. The inking rollers are pivoted into the middle area between the machine frames 44. More particularly, the inking roller frame 41, carrying two inking rollers assumes a vertical orientation, and the end portion (at the side of the supporting shaft) of the supporting member 36 holding the frame 41 is received within the stowing recesses 55 (see FIGS. 4 and 5, especially) that are formed in the undersides of the yoke arms 40. The first inking roller 42 is now held between the yoke arms 40 and the second inking roller 43 is held below the first inking roller 42 and at the rear side of the printing head 45. The inking rollers are stowed to fill otherwise useless space, and the whole body of the label printing machine is made compact.

In FIG. 8, the stopper projection 9 of the operation link 7 comes into contact with the connecting link 15 which stops further clockwise turning of the link 7. At this stage, the type faces 46 of the printing head 45 are contacting the surface of a label on the platen 54, thereby accomplishing label printing.

When the hand lever 2 is released, the multi-link mechanism returns to the rest position shown in FIG. 5. At the same time, the printed label unit 56 is passed under the applicator 57 to be applied to the surface of an article.

In operation of the inking roller 42 and 43, the first inking roller 42 is rolled over the faces of the types 46 with a predetermined pressure by the guiding means because the supporting shaft 34 at the end portion of the supporting member 36 is guided by and slid through the horizontal slot 28 of the guide link 27. Accordingly, when the inking roller 42 is rolled over the type faces 46, the outer surface of the roller 42 is depressed such that, when the depressed portion of the inking roller 42 recovers its original shape, the ink stored at the center of the inking roller 42 is pumped to the outer surface of the inking roller. Therefore, the application of ink to the type faces 46 can always be uniform and sufficient.

After the inking by the first inking roller 42, the second inking roller 43 is brought into contact with the type faces 46 under the urging of the spring 25. However, the bearing plates 58 on both sides of roller 43 are rolled on the undersurface of the printing head 45. Therefore, the second inking roller 43 can be rolled on the type faces 46 without being unnecessarily depressed so as to neatly finish off the inking. Accordingly, evenly distributed ink application can be easily attained.

The inking device of the invention has the following advantages:

(a) The ink-impregnated inking rollers are brought into contact with the type faces under certain pressures by means of a movable guiding mechanism. Therefore, the quantity of ink that is applied to the type face is always constant, and precise printing of labels can be attained.

(b) For pressing the inking rollers against the type faces at constant pressures, a particular link mechanism is employed. This mechanism differs from conventional devices that use spring action. Therefore, the force required to manually squeeze the hand lever can be minimized, and operator fatigue can be reduced.

(c) The inking rollers and their operating links do not protrude in front of the machine body when the hand lever is squeezed, and they can be stowed within the machine body because of the link mechanism. Therefore, they do not obstruct the view in front of the label printing machine and accurate applying of labels to the surfaces of articles can be easily accomplished.

In view of the above, the inking device of the present invention is quite suitable for label printing machines to print optical character reader readable characters and bar codes on labels, or the like, where highly precise printing is required.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. In a label printing machine, comprising a machine frame; said machine frame having a front end; a platen supported by said machine frame; a yoke movably supported by said machine frame for motion in a print direction toward said platen and in the opposite direction; said yoke being pivotally supported at a first pivot on said machine frame for pivotal motion with respect to said machine frame and extending from said first pivot toward said machine frame front end; a print head supported by and movable with said yoke, and including types opposable to and movable to said platen;

inking means for inking said types comprising:

an inking roller; a support for said linking link means connecting said yoke and said inking roller support; said support holding said inking roller at one side, measured across said print direction, of said print head types before said yoke moves in said print direction; said link means moving said support to move said inking roller past said types in an inking direction, that crosses said print direction, as said yoke moves in said print direction, and said inking direction being directed into said machine frame such that when said types move to said platen, said inking roller is stowed inside said machine frame;

said link means comprises:

a first link including guide means for said support such that said support moves along and with respect to said guide means in said inking direction;

a second linkage connected with said support for moving said support in said inking direction along said guide means;

a third linkage connected with said first link for moving said first link generally in said inking direction and into said machine frame; said support remaining in engagement with said first link for being moved into said machine frame rearwardly from said machine frame front end with said first link;

said second and said third linkages being connected with said yoke for moving as described as said yoke moves in said print direction whereby the ink roller and support, as a result of the recited interconnection of the first link, the second and third linkages with the support, is given a motion in said inking direction faster than the motion of said first link in said inking direction.

2. The label printing machine of claim 1, wherein said third linkage comprises a fourth link pivotally attached to said first link; said third linkage connection to said yoke being a pivotable connection; a fifth linkage pivotally connected to said frame at a first frame pivot, pivotally connected to said yoke at a first yoke pivot and pivotally connected to said fourth link, such that movement of said yoke to said platen pivots said fourth link which, in turn, moves said first link into said machine frame and away from said machine frame front end.

3. The label printing machine of claim 1, wherein said second linkage comprises a fourth link pivotally attached to said yoke at a first yoke pivot which serves as the said connection of said second linkage to said yoke; said fourth link being connected to said inking roller support at a location remote from said first yoke pivot; a fifth linkage pivotally connected to said frame at a first frame pivot, pivotally connected to said yoke at a second yoke pivot and pivotally connected to said fourth link, such that movement of said yoke to said platen pivots said fifth linkage which, in turn, pivots said fourth link to move said support in said inking direction.

4. The label printing machine of claim 3, wherein said third linkage comprises a sixth link pivotally attached to said first link; said third linkage connection to said yoke being a pivotable connection; said fifth linkage being pivotally attached to said sixth link, such that movement of said yoke to said platen pivots said sixth link, which, in turn, moves said first link into said machine frame and away from its said front end.

5. The label printing machine of claim 4, wherein in the space between said first and second yoke pivots, said fifth linkage further comprises a spring-actuated operation link which is attached to said second yoke pivot and also comprises a contact pin; said fourth link supports said inking roller support; said fourth link being attached to the said first yoke pivot and being provided with an upraising portion to be brought into contact with said contact pin for raising said contact pin as said yoke pivots in said print direction, thereby pivoting said sixth link and moving said first link also in said inking direction.

6. The label printing machine of claim 1, wherein said guide means for said inking roller support comprise a supporting shaft attached to said inking roller support and slots formed in said link means to guide said supporting shaft in a sliding manner.

7. The label printing machine of claim 1, wherein when said support and said inking roller are at said one side of said print head types, said support is at an orientation that is generally across the orientation of said types then opposable to said platen; said link means being adapted to pivot said support with respect to to said first link to an orientation generally paralleling the orientation of said types then opposable to said platen while said inking roller moves in said inking direction past said types; said link means being thereafter adapted to pivot said support with respect to said first link to an orientation that is again generally across the orientation of said types then opposable to said platen, when said support is moved in said inking direction past said types by said link means; said link means causing said support to pivot in only one direction with respect to said first link as said support moves in said inking direction, and said support pivoting in the same general pivot direction as said first link, but said link means causing said support to pivot through a greater pivot arc with respect to said first link than said first link pivots through as said support moves in said inking direction.

8. The label printing machine of claim 7, further comprising a second said inking roller supported on said support, and the said orientation of said support being defined by the plane joining the axes of the two said inking rollers.

9. The label printing machine of claim 4, wherein when said support and said inking roller are at said one side of said print head types, said support is at an orientation that is generally across the orientation of said types then opposable to said platen, said link means being adapted to pivot said support with respect to said first link to an orientation generally paralleling the orientation of said types then opposable to said platen while said inking roller moves in said inking direction past said types; said link means being thereafter adapted to pivot said support with respect to said first link to an orientation that is again generally across the orientation of said types then opposable to said platen, when said support is moved in said inking direction past said types by said link means; said link means causing said support to pivot in only one direction with respect to said first link as said support moves in said inking direction, and said support pivoting in the same general pivot direction as said first link, but said link means causing said support to pivot through a greater pivot arc with respect to said first link than said first link pivots through as said support moves in said inking direction.

10. The label printing machine of claim 4, wherein said guide means for said inking roller support comprise a supporting shaft attached to said inking roller support and slots formed in said link means to guide said supporting shaft in a sliding manner.

11. In a label printing machine, comprising; a machine frame; a platen supported by said machine frame; a yoke movably supported by said machine frame for motion in a print direction toward said platen and in the opposite direction; a print head supported by and movable with said yoke, and including types opposable to and movable to said platen;

inking means for inking said types, comprising:

an inking roller; a support for said inking roller;

link means comprising said yoke and said inking roller support; said support holding said inking roller at one side, measured across said print direction, of said print head types before said yoke moves in said print direction; said link means moving said support to move said inking roller past said types in an inking direction, that crosses said print direction, as said yoke moves in said print direction, and said inking direction being directed into said machine frame such that when said types move to said platen, said inking roller is stowed inside said machine frame;

said link means comprises:

a first link including guide means for said support, such that said support moves along said guide means in said inking direction;

a second linkage connected with said support for moving said support in said inking direction along and with respect to said guide means;

a third linkage connected with said first link for moving said first link generally in said inking direction into said machine frame; said support remaining in engagement with said first link for being moved into said machine frame with said first link;

said second and said third linkages being connected with said yoke for moving as described as said yoke moves in said print direction whereby the ink roller and support, as a result of the recited interconnection of the first link, the second and third linkages with the support, is given a motion in said inking direction faster than the motion of said first link in said inking direction.

12. The label printing machine of claim 11, wherein when said support and said inking roller are at said one side of said print head types, said support is at an orientation that is generally across the orientation of said types then opposable to said platen; said link means being adapted to pivot said support with respect to said link means to an orientation generally paralleling the orientation of said types then opposable to said platen while said inking roller moves in said inking direction past said types; said link means being thereafter adapted to pivot said support with respect to said link means to an orientation that is again generally across the orientation of said types then opposable to said platen, when said support is moved in said inking direction past said types by said link means, said link means causing said support to pivot in only one direction with respect to said link means as said support moves in said inking direction.

13. In a label printing machine, comprising; a machine frame; a platen supported by said machine frame; a yoke movably supported by said machine frame for motion in a print direction toward said platen and in the opposite direction; a print head supported by and movable with said yoke, and including types opposable to and movable to said platen;

inking means for inking said types, comprising;

an inking roller; a support for said inking roller;

link means connecting said yokes and said inking roller support; said support holding said inking roller at one side, measured across said print direction, of said print head types before said yoke moves in said print direction; said link means moving said support to move said inking roller past said types in an inking direction, that crosses said print direction, as said yoke moves in said print direction, and said inking direction being directed into said machine frame such that when said types move to said platen, said inking roller is stowed inside said machine frame;

said link means comprises:

a first link including guide means for said support such that said support moves along said guide means in said inking direction;

second means for moving said support along and with respect to said guide means in said inking direction;

third means for moving said first link, with said support still in engagement therewith and movable therewith, generally in said inking direction and into said machine frame;

said second and said third means being connected with said yoke for moving as described as said yoke moves in said print direction whereby the ink roller and support, as a result of the recited interconnection of the first link, the second and third linkages with the support, is given a motion in said inking direction faster than the motion of said first link in said inking direction.

* * * * *

UNITED STATES PATENT AND TRADEMARK OFFICE

CERTIFICATE OF CORRECTION

PATENT NO. : 4,178,849

DATED : December 18, 1979

INVENTOR(S) : Yo Sato

It is certified that error appears in the above-identified patent and that said Letters Patent are hereby corrected as shown below:

At column 8, line 7, change "linking" to -- inking roller --

Signed and Sealed this

*Seventeenth* Day of *March 1981*

[SEAL]

*Attest:*

RENE D. TEGTMEYER

*Attesting Officer*

*Acting Commissioner of Patents and Trademarks*